US011654541B2

(12) United States Patent
Tsai et al.

(10) Patent No.: US 11,654,541 B2
(45) Date of Patent: May 23, 2023

(54) TOOL FOR SKATEBOARDS

(71) Applicant: Wen-Tang Tsai, Taichung (TW)

(72) Inventors: Wen-Tang Tsai, Taichung (TW); Mark Groenhuyzen, Huntington Beach, CA (US)

(73) Assignee: Wen-Tang Tsai, Taichung (TW)

( * ) Notice: Subject to any disclaimer, the term of this patent is extended or adjusted under 35 U.S.C. 154(b) by 81 days.

(21) Appl. No.: 17/398,988

(22) Filed: Aug. 10, 2021

(65) Prior Publication Data

US 2023/0048458 A1 Feb. 16, 2023

(51) Int. Cl.

| | |
|---|---|
| ***B25F 1/02*** | (2006.01) |
| ***B25G 1/10*** | (2006.01) |
| ***B25G 1/08*** | (2006.01) |
| *A63C 17/00* | (2006.01) |

(52) U.S. Cl.

CPC ..... *B25F 1/02* (2013.01); *B25G 1/085* (2013.01); *B25G 1/105* (2013.01); *A63C 17/0006* (2013.01)

(58) Field of Classification Search

None

See application file for complete search history.

(56) References Cited

U.S. PATENT DOCUMENTS

| | | | | |
|---|---|---|---|---|
| 4,520,697 | A * | 6/1985 | Moetteli | B25B 13/465 81/177.85 |
| 6,279,434 | B1 * | 8/2001 | Brown | B25B 13/48 81/439 |
| 7,127,766 | B1 * | 10/2006 | Carter | B25B 13/48 81/437 |
| 2011/0030146 | A1 * | 2/2011 | Wu | B25B 13/463 407/29.1 |
| 2020/0376643 | A1 * | 12/2020 | Statman | B25B 15/008 |

* cited by examiner

*Primary Examiner* — Brian D Keller

(57) ABSTRACT

A tool is devised for skateboards. The tool includes a grip, an Allen key/screwdriver, a driver and three sockets. The grip includes a non-circular cavity in an end and a groove in a side. The first and second sockets are connected to the grip, opposite to each other. The Allen key/screwdriver is selectively inserted in the groove. The driver is selectively inserted in the cavity. The third socket is formed at an end of the driver. The third socket includes an axial bore, a radial bore, and a cutout opposite to the radial bore.

5 Claims, 14 Drawing Sheets

TOOL FOR SKATEBOARDS

BACKGROUND OF INVENTION

1. Field of Invention

The present invention relates to skateboards and, more particularly, to a tool for skateboards.

2. Related Prior Art

Skateboards can be used for transportation. Skateboards can be used for sport. Skateboarding is even included in the Olympic games of 2021. Skateboarding is popular among teenagers and young adults. Each skateboard has to be disassembled, maintained and/or repaired and reassembled after it is used for a certain period of time. It requires more multiple tools for such purposes. For example, a wrench, sockets and Allen key/screwdrivers are needed to. However, it is difficult to carry such tools.

The present invention is therefore intended to obviate or at least alleviate the problems encountered in the prior art.

SUMMARY OF INVENTION

It is the primary objective of the present invention to provide a convenient tool for skateboards.

To achieve the foregoing objective, the tool is devised for skateboards. The tool includes a grip, an Allen key/screwdriver, a driver and three sockets. The grip includes a non-circular cavity in an end and a groove in a side. The first and second sockets are connected to the grip, opposite to each other. The Allen key/screwdriver is selectively inserted in the groove. The driver is selectively inserted in the cavity. The third socket is formed at an end of the driver. The third socket includes an axial bore, a radial bore, and a cutout opposite to the radial bore.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
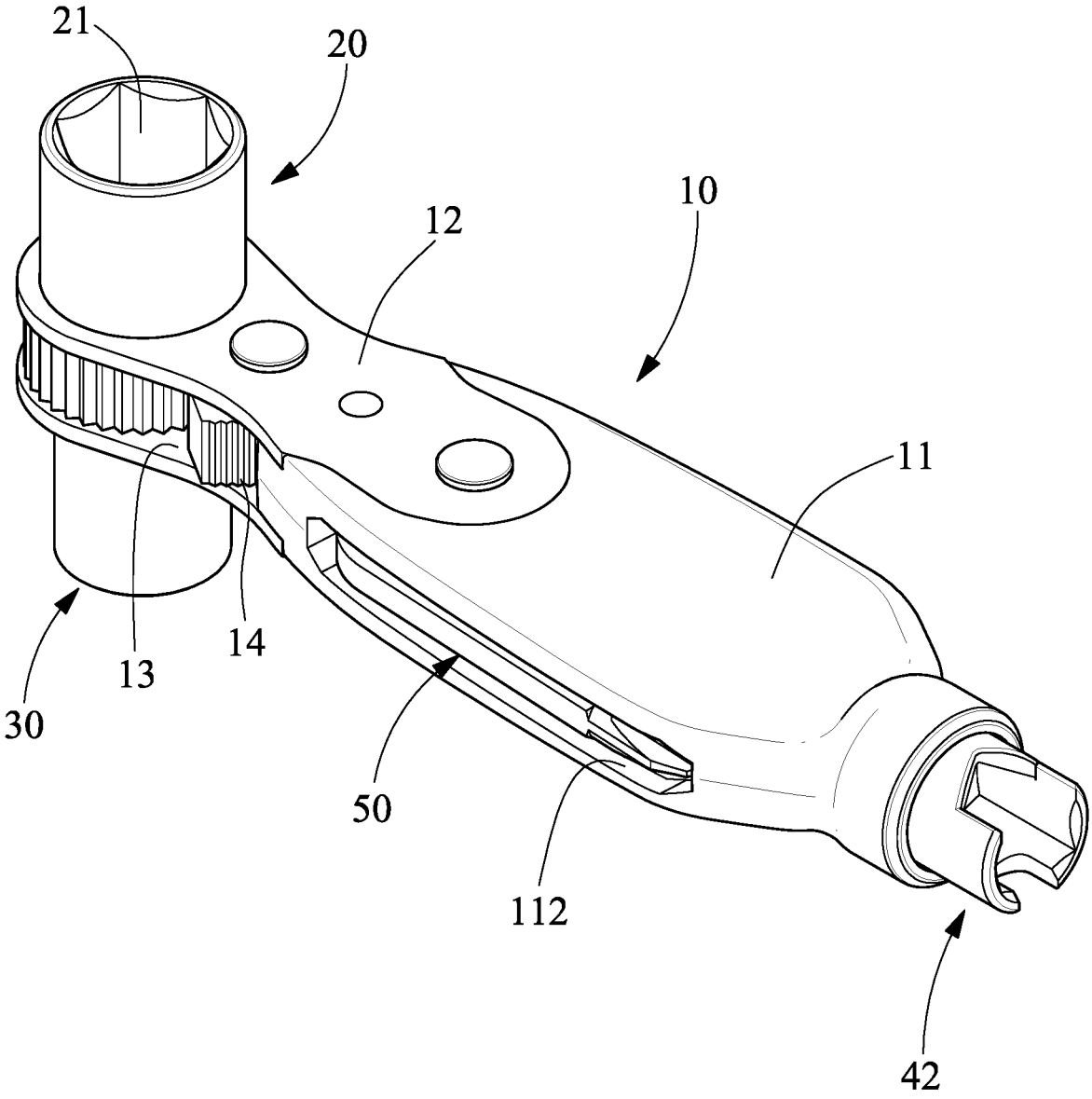
FIG. 1 is a perspective view of a skateboard-specific tool according to the preferred embodiment of the present invention.
Figure 2:
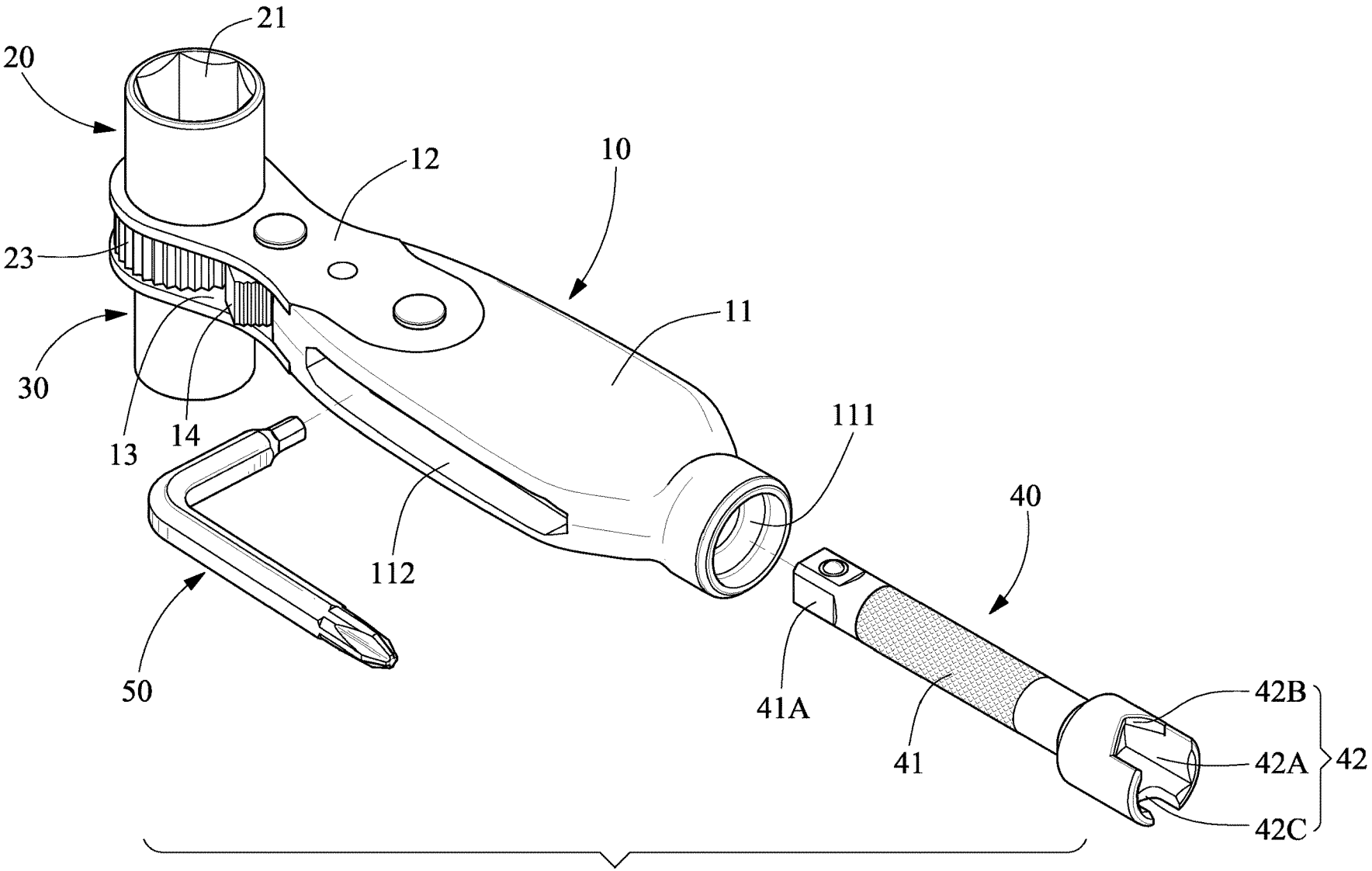
FIG. 2 is an exploded view of the tool shown in FIG. 1.
Figure 3:
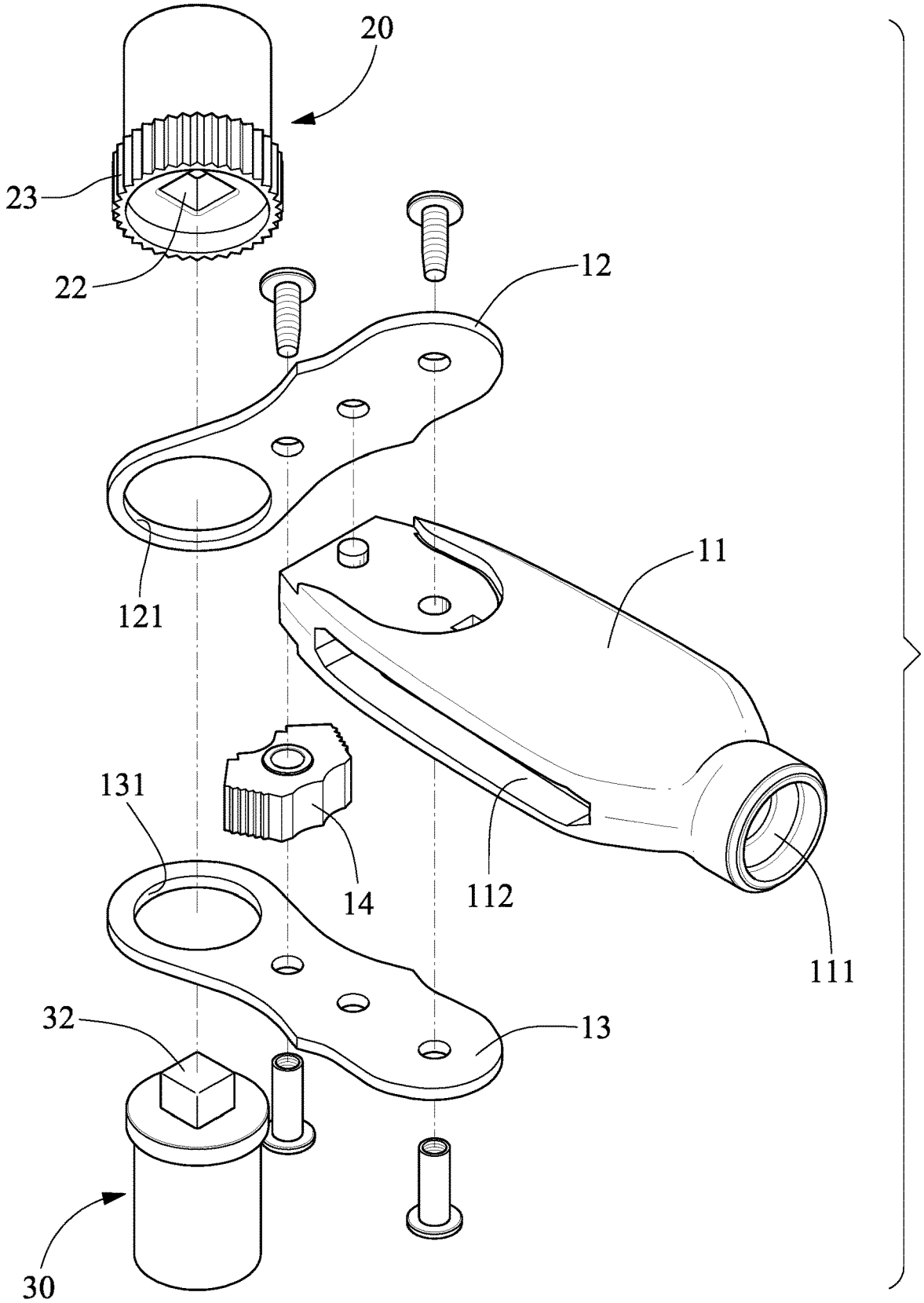
FIG. 3 is another exploded view of the tool shown in FIG. 1.
Figure 4:
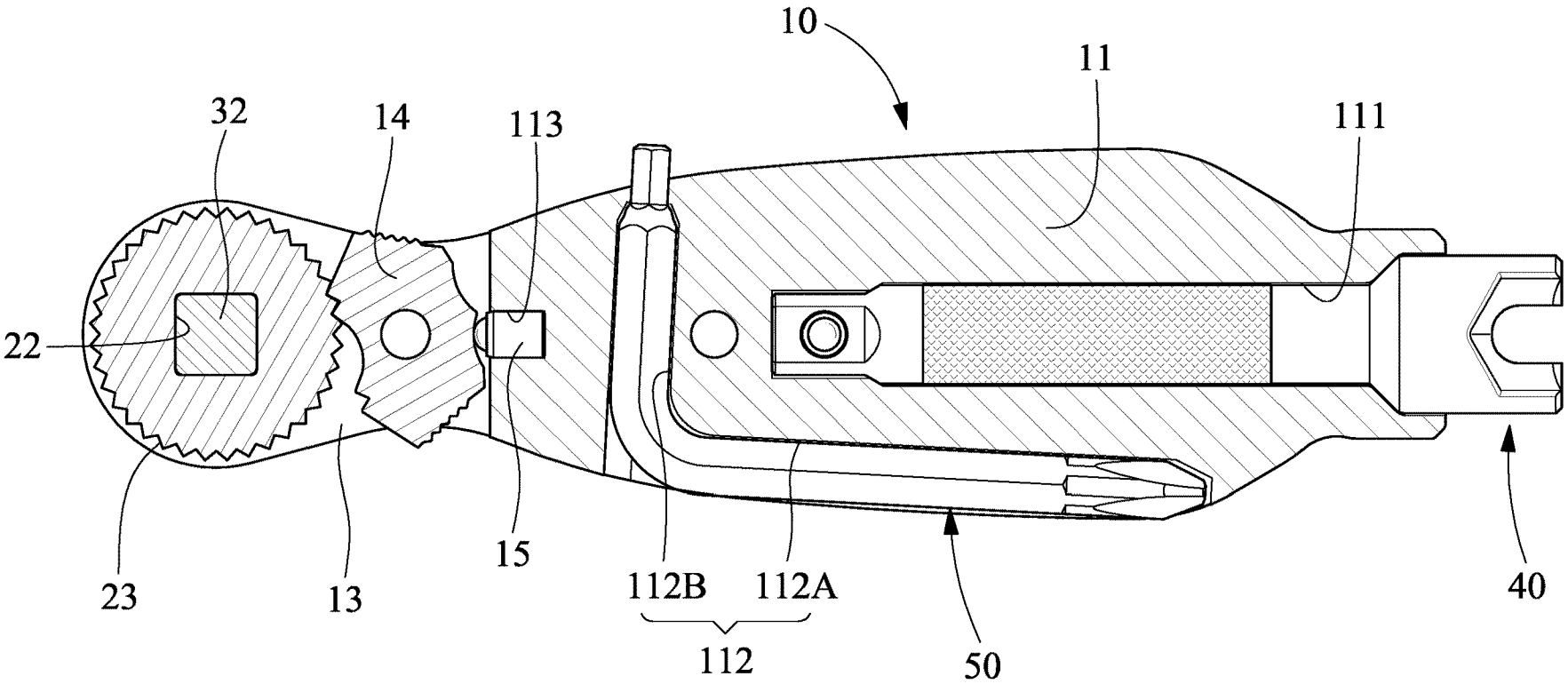
FIG. 4 is a cross-sectional view of the tool shown in FIG. 1.
Figure 5:
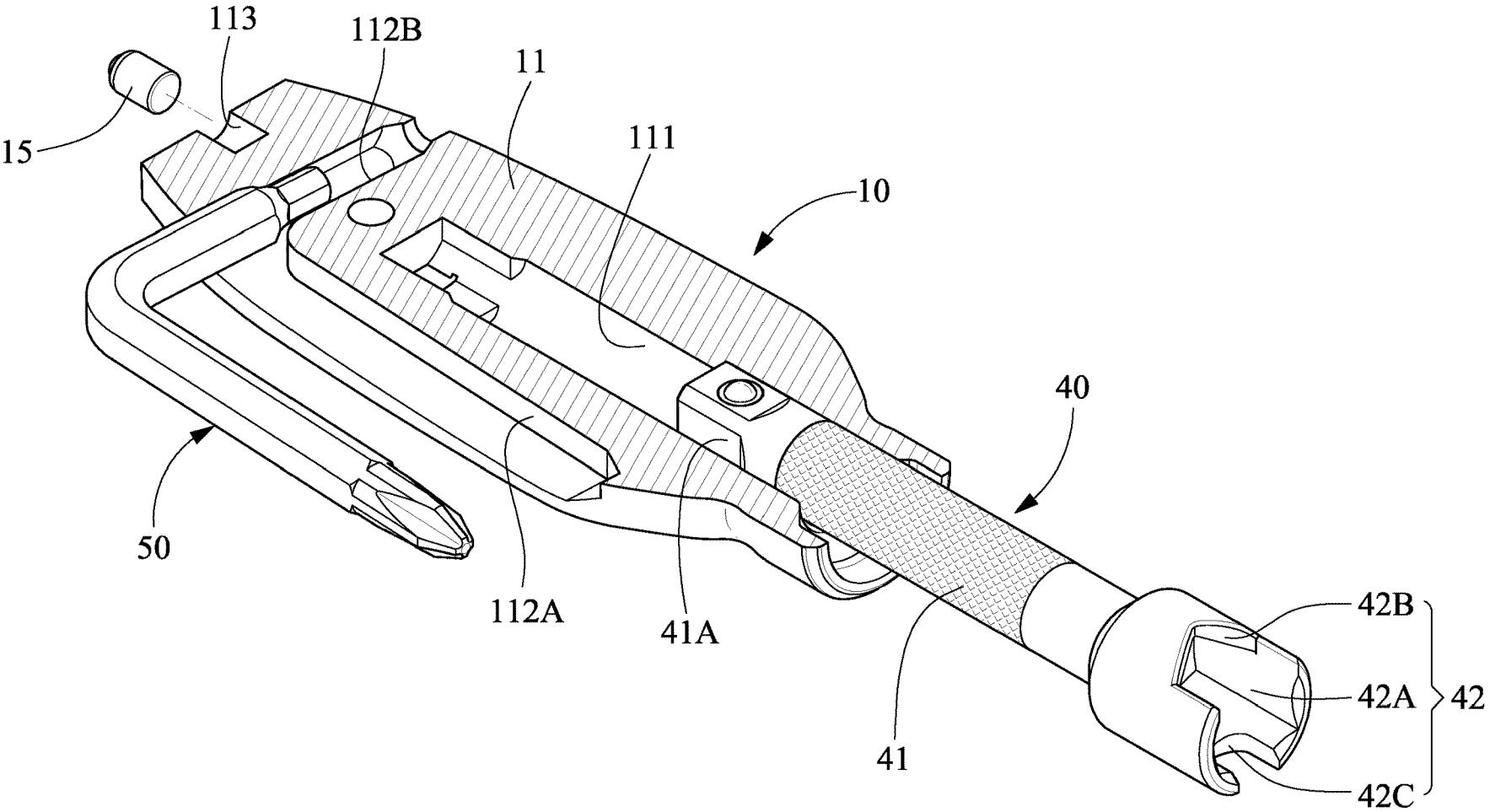
FIG. 5 is a cut-away view of the tool shown in FIG. 1.

Referring to FIGS. 1 through 5, a tool is devised for skateboards. The tool includes a handle 10, a first socket 20, a second socket 30, a driver 40, and an Allen key/screwdriver 50 according to the preferred embodiment of the present invention. The handle 10 includes a grip 11, two locking plates 12 and 13, a pawl 14, and a spring-biased detent 15.

The grip 11 includes a cavity 111, a groove 112 and a recess 113. The cavity 111 and the recess 113 are made in two opposite ends of the grip 11. The cavity 111 is polygonal cavity. The groove 112 is made in a side of the grip 11. The groove 112 includes two sections 112A and 112B extending perpendicular to each other. The section 112B of the groove 112 transversely extends throughout the grip 11. The section 112B of the groove 112 is preferably in a stepped configuration.

The locking plates 12 and 13 are substantially identical to each other in shape. The locking plate includes an opening 121. The locking plate 13 includes an opening 131. The locking plates 12 and 13 are located on two opposite sides of the grip 11 so that the recess 113 is located between the locking plates 12 and 13. The locking plates 12 and 13 are connected to the grip 11 by screws and nuts (not numbered).

The pawl 14 is located between the locking plates 12 and 13. The pawl 14 is in adjacent to the recess 113.

The spring-biased detent 15 includes an end inserted in the recess 113 and another end in contact with the pawl 14. The spring-biased detent 15, the pawl 14 and the toothed portion 23 of the socket 20 together render the tool a selectively one-way wrench.

The socket 20 is inserted in the opening 121 of the locking plate 12. The socket 20 includes a bore 21, a mortise 22, and a toothed portion 23. The bore 21 and the mortise 22 are made in two opposite ends of the socket 20. The bore 21 is preferably a hexagonal one corresponding to a head of a threaded bolt or a nut. The mortise 22 is preferably a square one. The toothed portion 23 is formed on the periphery of the socket 20. The toothed portion 23 of the socket 20 is for engagement with the pawl 14.

Figure 7:
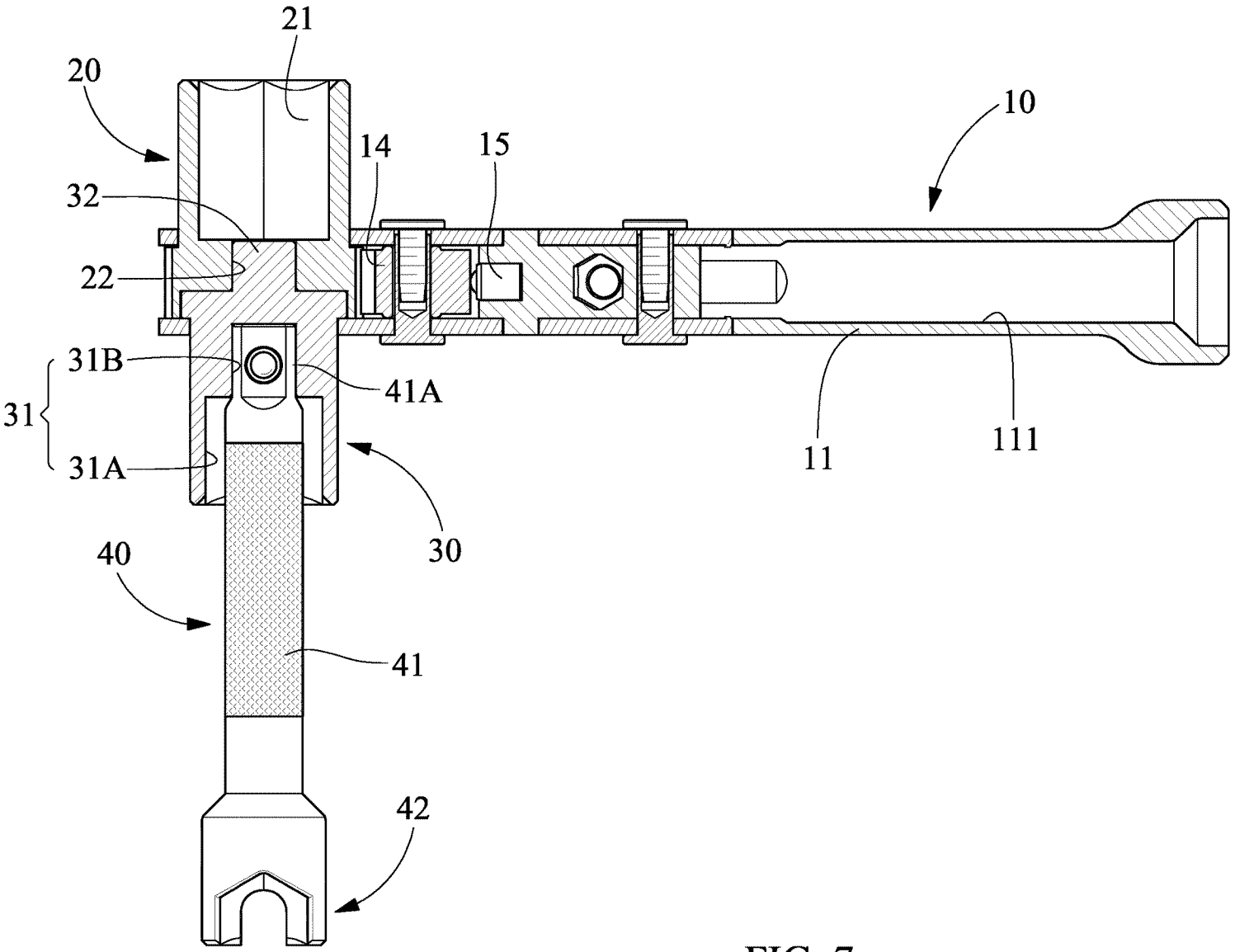
FIG. 7 is a cross-sectional view of the tool shown in FIG. 6.

The socket 30 is inserted in the opening 131 of the locking plate 13. The socket 30 includes a bore 31 and a tenon 32. The bore 31 and the tenon 32 are located at two opposite ends of the socket 30. The bore 31 is preferably a hexagonal one corresponding to a head of a threaded bolt or a nut. The tenon 32 is a square one inserted in the mortise 22. Preferably, the bore 31 is in a stepped one including two coaxial sections 31A and 31B (FIG. 7). Preferably, the section 31A of the bore 31 is a hexagonal one corresponding to a head of a threaded bolt or a nut. Preferably, the section 31B of the bore 31 is a square one.

The driver 40 includes a shaft 41, a socket 42 formed at an end of the shaft 41, and an insert 41A formed at another end of the shaft 41. Selectively, the shaft 41 can be inserted in the cavity 111 of the handle 10 while the socket 42 is located out of the cavity 111. Selectively, the insert 41A can be inserted in the section 31B of the socket 30.

The socket 42 includes an axial bore 42A, a radial bore 42B and a cutout 42C. The axial bore 42A is made in an end of the socket 42. The radial bore 42B and the cutout 42C are made in two opposite sides of the socket 42, coaxial with each other. The radial bore 42B and the cutout 42C are in communication with the axial bore 42A. Preferably, each of the axial bore 42A and the radial bore 42B is adapted for receiving a head of a threaded bolt or a nut.

Selectively, the Allen key/screwdriver 50 can be inserted in the groove 112 of the handle 10. Preferably, the Allen key/screwdriver 50 is operable to drive a threaded bolt or a screw.

Figure 6:
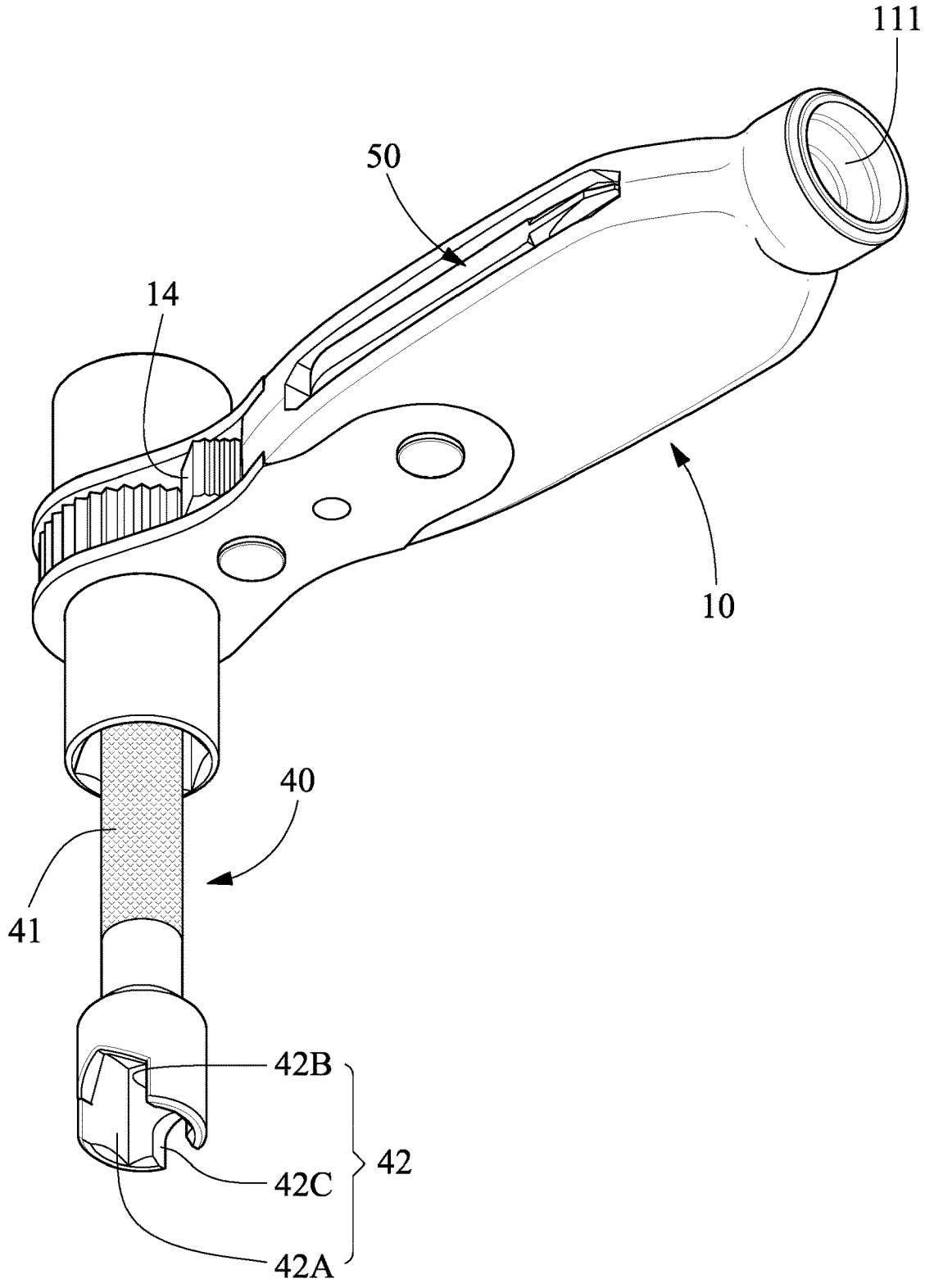
FIG. 6 is another perspective view of the tool shown in FIG. 1.
Figure 8:
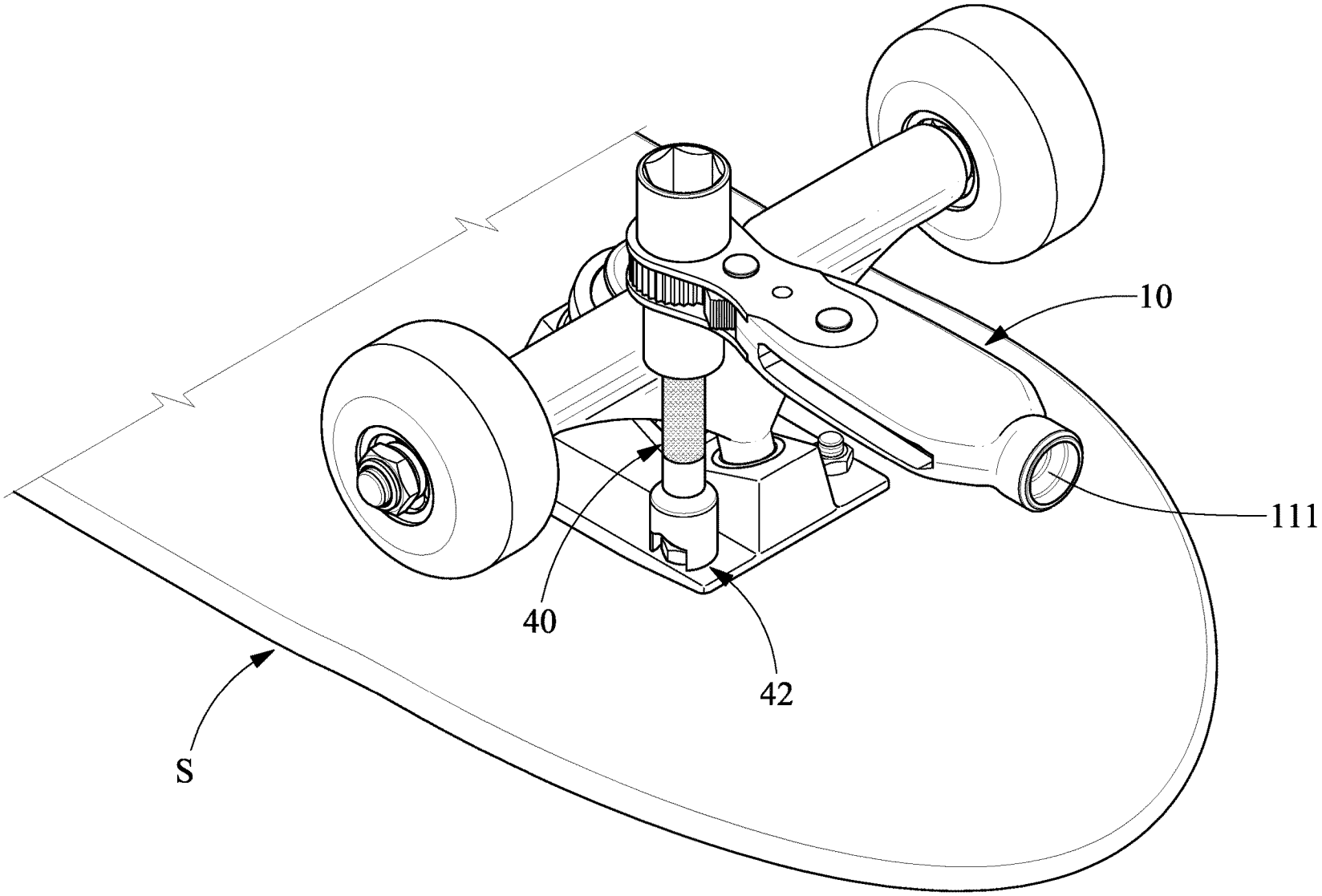
FIG. 8 is a perspective view of the tool shown in FIG. 6 used for a skateboard.

Referring to FIGS. 6 through 8, the driver 40 is moved from the cavity 111. The insert 41A of the driver 40 is inserted in the section 31B of the bore 31 of the socket 30. Then, the socket 42 of the driver 40 is used to drive a nut used on a skateboard S. The shaft 41 of the driver 40 is made with an adequate length so that the operation of the handle 10 is not interfered with by other components of the skateboard S.

Figure 9:
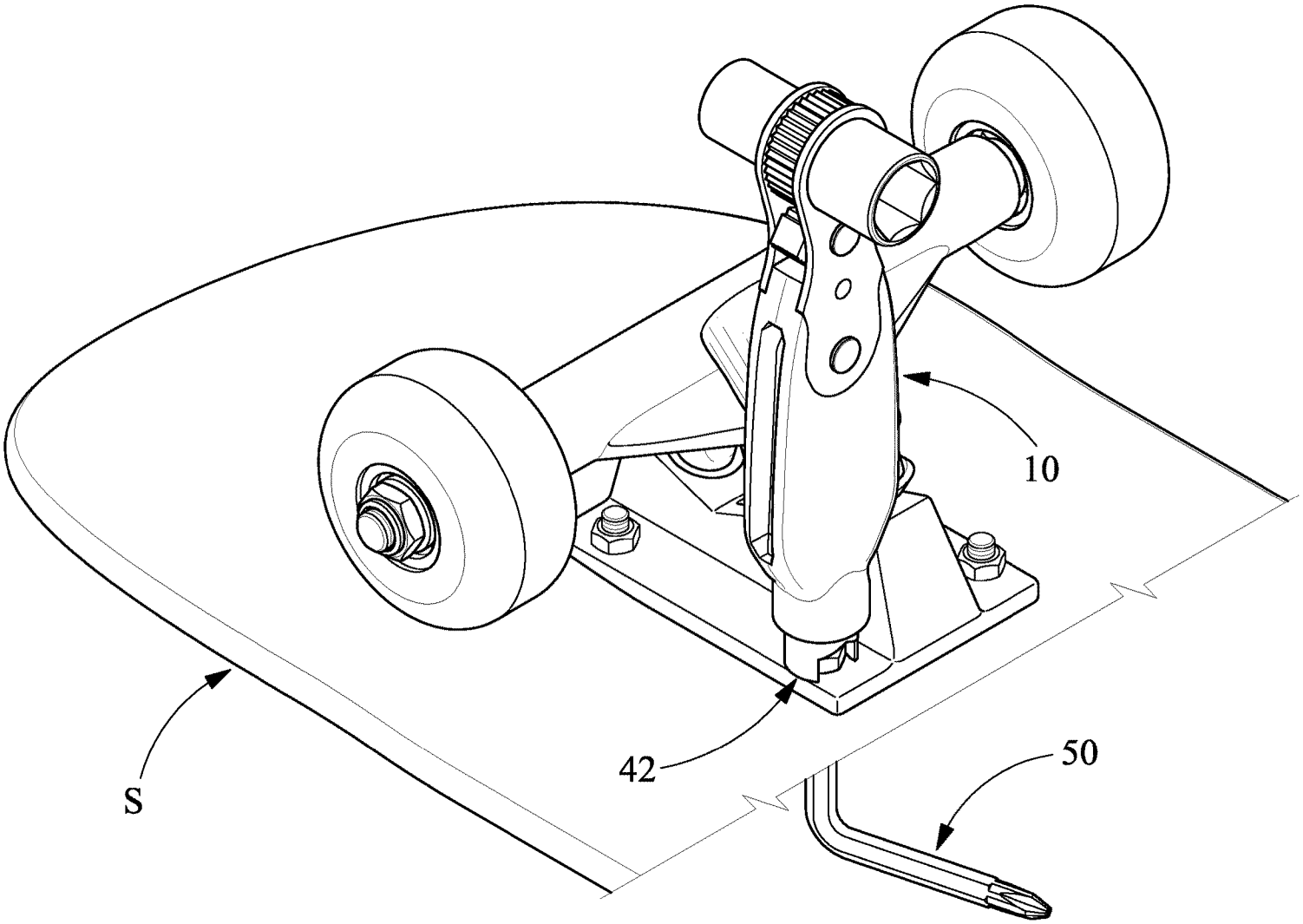
FIG. 9 is a perspective view of the tool and the skateboard in another position than shown in FIG. 8.
Figure 10:
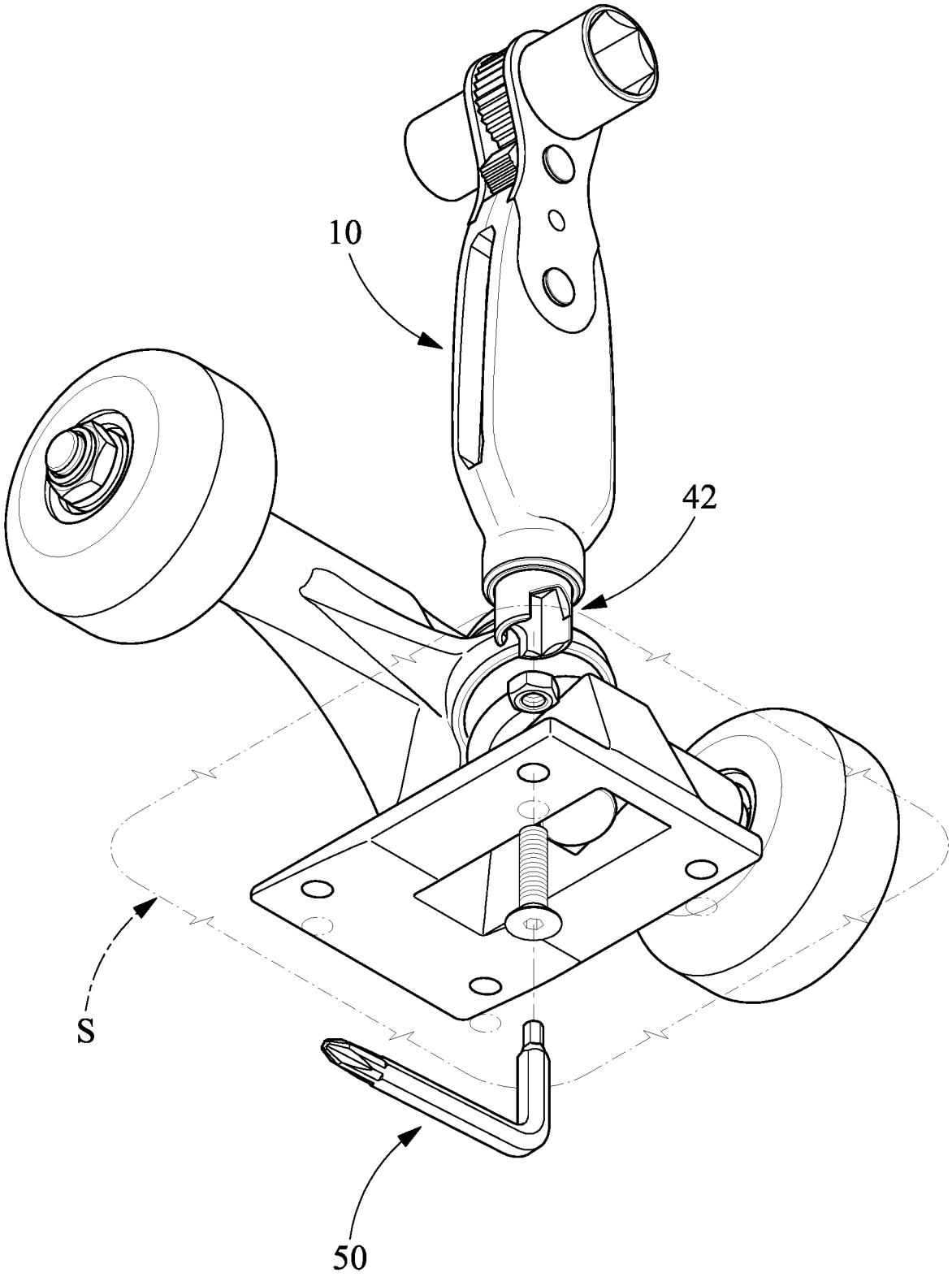
FIG. 10 is a perspective view of the tool and the skateboard in another position than shown in FIG. 9.

Referring to FIGS. 9 and 10, the Allen key/screwdriver 50 is moved from the groove 112 of the handle 10. The shaft 41 of the driver 40 is inserted in the cavity 111 of the grip 11. For example, a section of the Allen key/screwdriver 50 is inserted in a bore made in a head of a threaded bolt used on the skateboard S and the axial bore 42A of the socket 42 of the driver 40 receives a nut used on the skateboard S. Thus, the tool is operable to drive the threaded bolt relative to the nut.

Figure 11:
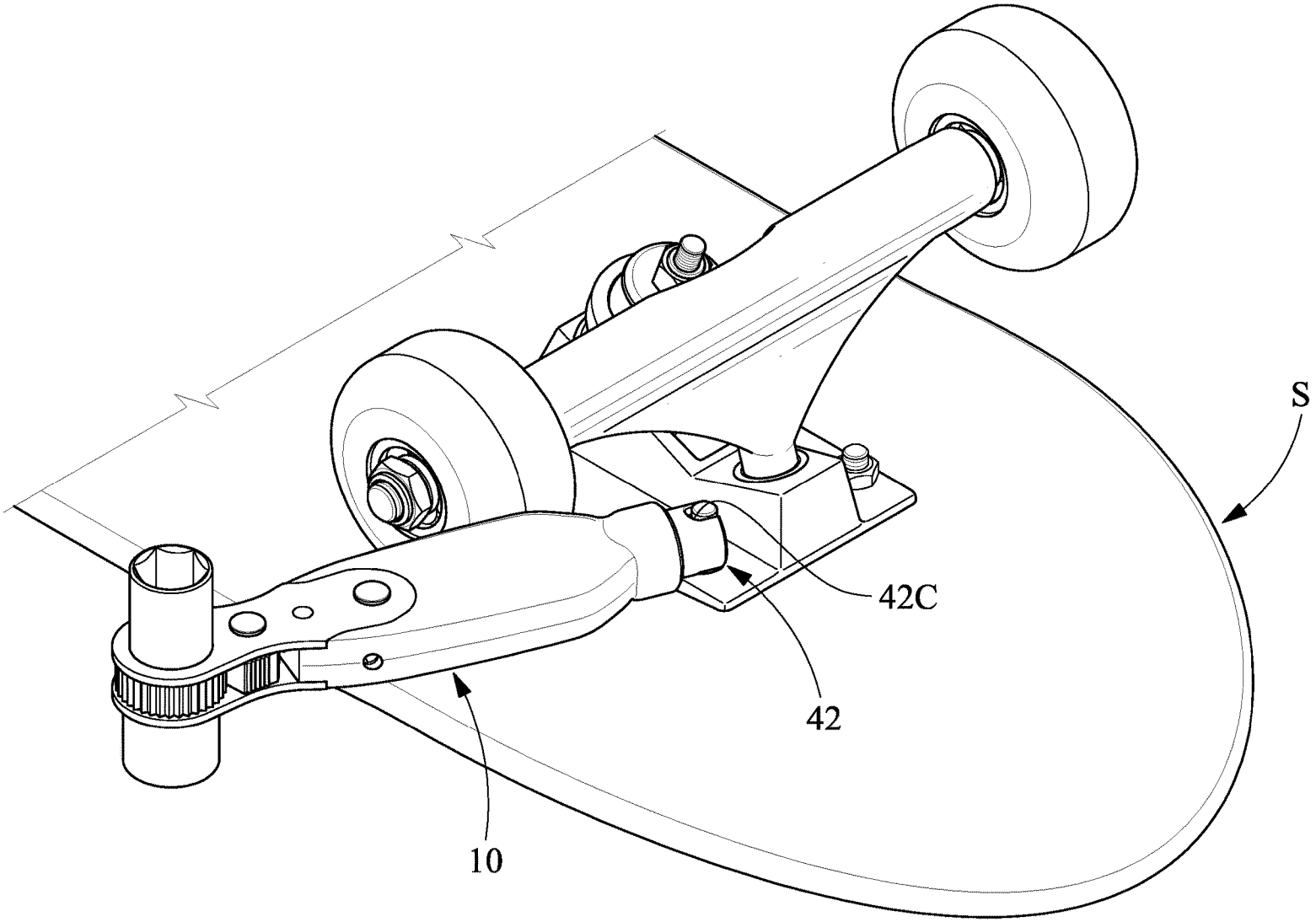
FIG. 11 is a perspective view of the tool and the skateboard in another position than shown in FIG. 10.

Referring to FIG. 11, the shaft 41 of the driver 42 is inserted in the cavity 111 of the grip 11. The radial bore 42B of the cutout 42C of the socket 42 receives the threaded bolt used on the skateboard S. Thus, the tool is operable to drive the threaded bolt relative to the skateboard S.

Figure 12:
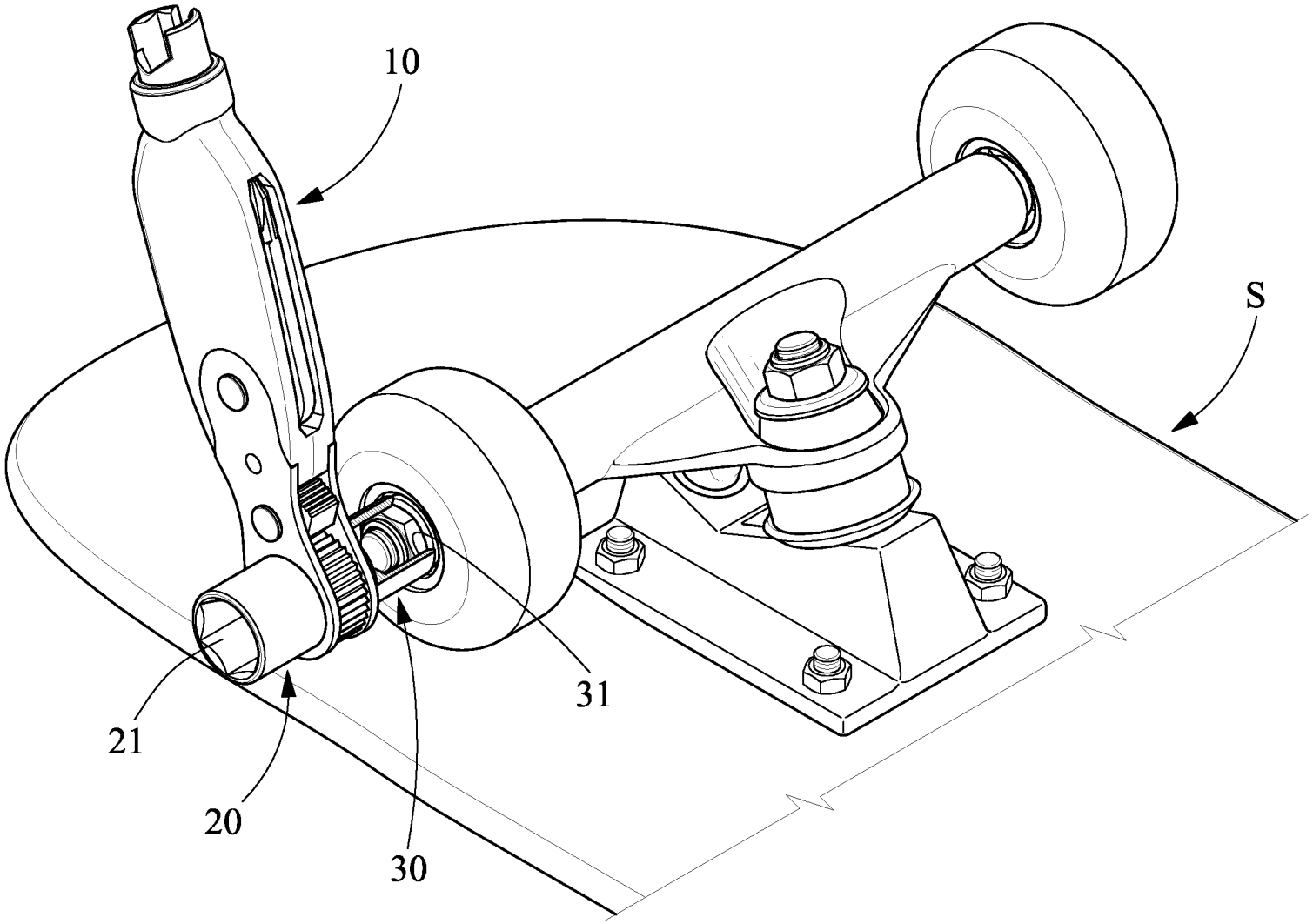
FIG. 12 is a perspective view of the tool and the skateboard in another position than shown in FIG. 11.
Figure 13:
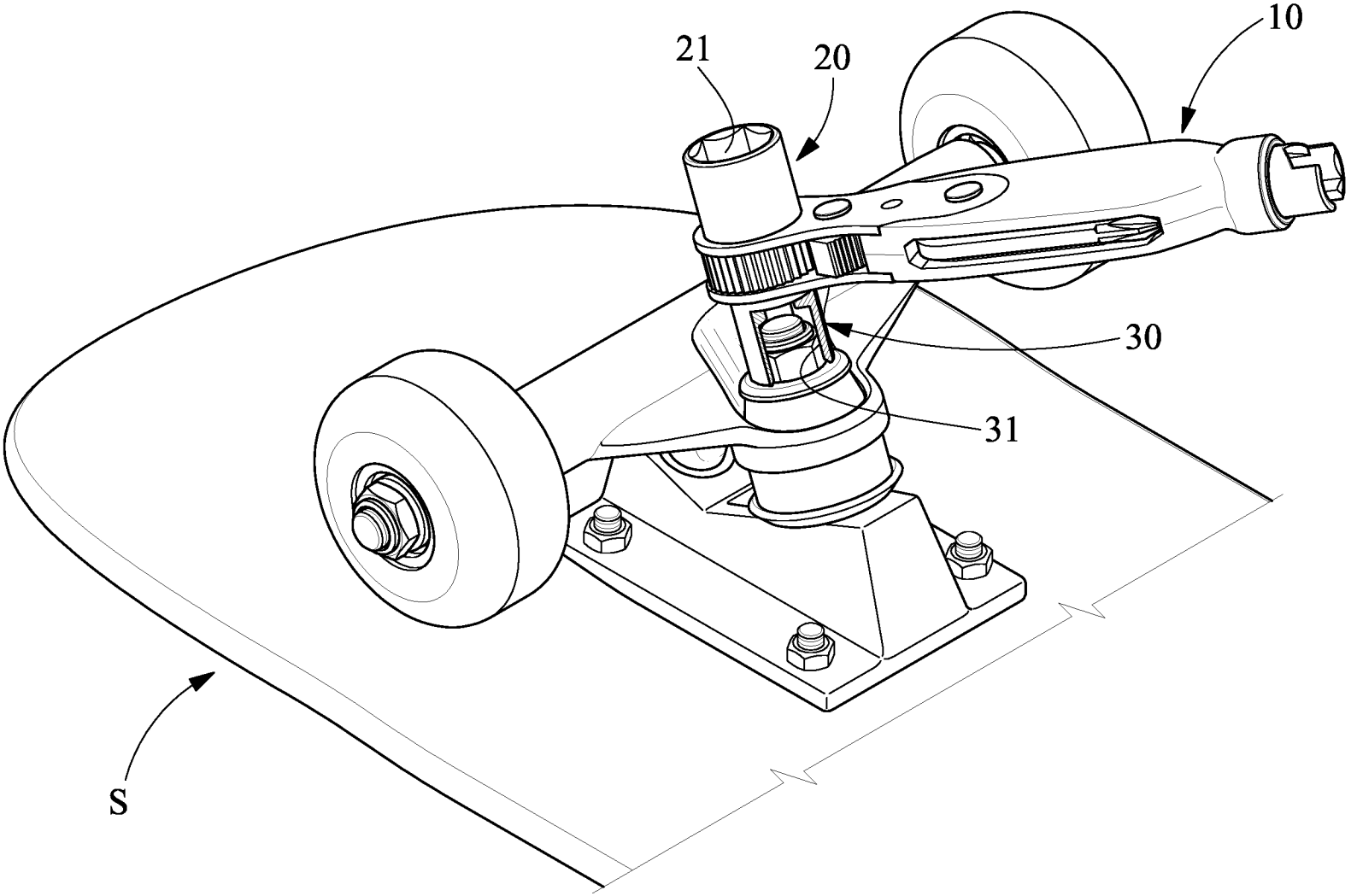
FIG. 13 is a perspective view of the tool and the skateboard in another position than shown in FIG. 12.

Referring to FIGS. 7, 12 and 13, the bore 21 of the socket 20 and the bore 31 of the socket 30 are operable to receive nuts of different sizes used on the skateboard S.

Figure 14:
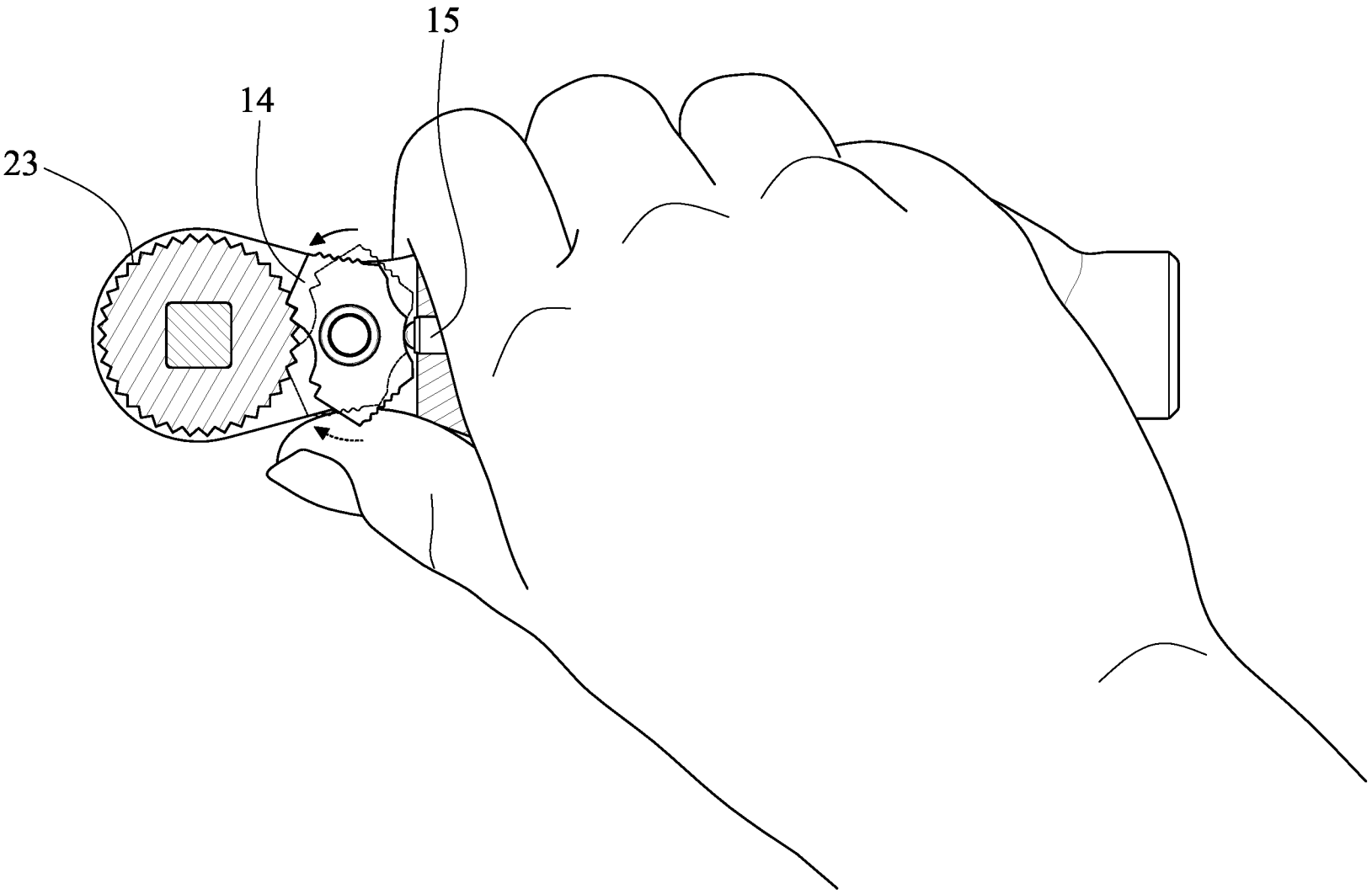
FIG. 14 is a perspective view of the tool and the skateboard in another position than shown in FIG. 13.

Referring to FIG. 14, the pawl 14 is switched between two positions relative to the spring-biased detent 15. In each of the positons, the handle is suitable to rotate, via the socket 20 or 30, a threaded bolt or a nut in a direction, but not vice versa.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A tool for skateboards, the tool comprising:

a handle comprising a grip comprising a non-circular cavity in an end and a groove in a side, a first locking plate connected to a side of the grip, and a second locking plate connected to another side of the grip;

a first socket connected to the first locking plate and formed with a toothed portion;

a second socket connected to the second locking plate;

a pawl pivotally connected to the first and second locking plates and engaged with the toothed portion;

a spring-biased detent comprising an end in contact with the pawl and another end connected to the grip;

an Allen key/screwdriver selectively inserted in the groove;

a driver selectively inserted in the cavity; and a third socket formed at an end of the driver, wherein the third socket comprises an axial bore, a radial bore, and a cutout opposite to the radial bore.

2. The tool according to claim 1, wherein the cavity is a polygonal cavity, wherein the driver comprises an insert and a shaft extending between the third socket and the insert.

3. The tool according to claim 2, wherein the second socket comprises a bore for receiving the insert of the driver.

4. The tool according to claim 1, wherein the grip comprises a recess for receiving the spring-biased detent.

5. A tool for skateboards, the tool comprising:

a handle comprising a grip comprising a non-circular cavity in an end and a groove in a side;

a first socket connected to the grip, wherein the first socket comprises a mortise in an end;

a second socket connected to the grip, opposite to the first socket, wherein the second socket comprises a tenon inserted in the mortise;

an Allen key/screwdriver selectively inserted in the groove;

a driver selectively inserted in the cavity; and a third socket formed at an end of the driver, wherein the third socket comprises an axial bore, a radial bore, and a cutout opposite to the radial bore, wherein the handle comprises a first locking plate connected to a side of the grip and a second locking plate connected to another side of the grip, and wherein each of the first and second locking plates comprises an opening for receiving one of the first and second sockets.

* * * * *